US008569220B2

(12) United States Patent
Gaudreault

(10) Patent No.: US 8,569,220 B2
(45) Date of Patent: Oct. 29, 2013

(54) HARD SURFACE CLEANING COMPOSITION

(75) Inventor: Rosemary Gaudreault, Park Ridge, IL (US)

(73) Assignee: Jelmar, LLC, Skokie, IL (US)

( * ) Notice: Subject to any disclaimer, the term of this patent is extended or adjusted under 35 U.S.C. 154(b) by 0 days.

(21) Appl. No.: 12/927,377

(22) Filed: Nov. 12, 2010

(65) Prior Publication Data

US 2012/0122757 A1 May 17, 2012

(51) Int. Cl.
*C11D 1/75* (2006.01)

(52) U.S. Cl.
USPC ..... 510/253; 510/238; 510/239; 510/240; 510/433; 510/434; 510/503; 510/506

(58) Field of Classification Search
USPC ..... 510/238, 239, 240, 253, 433, 434, 503, 510/506
See application file for complete search history.

(56) References Cited

U.S. PATENT DOCUMENTS

| | | | |
|---|---|---|---|
| 3,993,575 | A | 11/1976 | Howanitz et al. |
| 4,294,764 | A | 10/1981 | Rinehart |
| 4,690,779 | A | 9/1987 | Baker et al. |
| 4,983,317 | A | 1/1991 | Requejo et al. |
| 5,122,568 | A | 6/1992 | dePierne et al. |
| 5,139,614 | A | 8/1992 | dePierne et al. |
| 5,362,422 | A | 11/1994 | Masters |
| 5,384,063 | A | 1/1995 | Woo et al. |
| 5,399,280 | A | 3/1995 | Woo et al. |
| 5,468,303 | A | 11/1995 | Thomas, Sr. |
| 5,522,942 | A | 6/1996 | Graubart et al. |
| 5,635,462 | A | 6/1997 | Fendler et al. |
| 5,679,629 | A | 10/1997 | Kubota et al. |
| 5,691,291 | A | 11/1997 | Wierenga et al. |
| 5,700,772 | A | 12/1997 | Isobe et al. |
| 5,783,537 | A | 7/1998 | Ahmed et al. |
| 5,785,962 | A | 7/1998 | Hinz et al. |
| 5,817,615 | A | 10/1998 | Garabedian, Jr. et al. |
| 5,837,664 | A | 11/1998 | Black |
| 5,922,672 | A | 7/1999 | Stringer et al. |
| 5,925,606 | A | 7/1999 | Stamm |
| 5,929,007 | A | 7/1999 | Feng |
| 5,962,388 | A | 10/1999 | Sherry et al. |
| 5,990,064 | A | 11/1999 | Wierenga et al. |
| 5,990,066 | A | 11/1999 | Gordon et al. |
| 5,998,358 | A | 12/1999 | Herdt et al. |
| 6,015,780 | A | 1/2000 | Llosas Bigorra et al. |
| 6,017,872 | A | 1/2000 | Pedersen et al. |
| 6,034,181 | A | 3/2000 | Bazaj et al. |
| 6,103,686 | A | 8/2000 | Asakawa et al. |
| 6,121,219 | A | 9/2000 | Herdt et al. |
| 6,156,129 | A | 12/2000 | Hlivka et al. |
| 6,204,230 | B1 | 3/2001 | Taylor et al. |
| 6,251,845 | B1 | 6/2001 | Herbots et al. |
| 6,277,805 | B1 | 8/2001 | Kupneski |
| 6,281,182 | B1 | 8/2001 | Leonard et al. |
| 6,306,805 | B1 | 10/2001 | Bratescu et al. |
| 6,346,508 | B1 | 2/2002 | Leonard et al. |
| 6,384,010 | B1 | 5/2002 | Wagers |
| 6,399,563 | B1 | 6/2002 | Durbut et al. |
| 6,423,674 | B1 | 7/2002 | Williams et al. |
| 6,423,677 | B1 | 7/2002 | Van Eenam |
| 6,425,959 | B1 | 7/2002 | Man |
| 6,429,182 | B1 | 8/2002 | Julemont et al. |
| 6,429,183 | B1 | 8/2002 | Leonard et al. |
| 6,432,395 | B1 | 8/2002 | Rochon et al. |
| 6,436,445 | B1 | 8/2002 | Hei et al. |
| 6,436,885 | B2 | 8/2002 | Biedermann et al. |
| 6,436,892 | B1 | 8/2002 | Leonard et al. |
| 6,451,748 | B1 | 9/2002 | Taylor et al. |
| 6,479,453 | B2 | 11/2002 | Man |
| 6,489,285 | B2 | 12/2002 | Faber |
| 6,551,985 | B1 | 4/2003 | Bianchetti et al. |
| 6,559,111 | B2 | 5/2003 | Colurciello, Jr. et al. |
| 6,605,584 | B2 | 8/2003 | Fong et al. |
| 6,617,303 | B1 | 9/2003 | Smith et al. |
| 6,627,586 | B1 | 9/2003 | Brooks et al. |
| 6,627,590 | B1 | 9/2003 | Sherry et al. |
| 6,660,706 | B1 | 12/2003 | Koester et al. |
| 6,699,825 | B2 | 3/2004 | Rees et al. |
| 6,699,828 | B1 | 3/2004 | de Buzzaccarini et al. |
| 6,740,626 | B2 * | 5/2004 | Neumiller ..... 510/109 |
| 6,794,346 | B2 | 9/2004 | Wick |
| 6,821,939 | B1 | 11/2004 | Szewczyk et al. |
| 6,933,267 | B2 | 8/2005 | Colurciello et al. |

(Continued)

FOREIGN PATENT DOCUMENTS

| | | |
|---|---|---|
| GB | 1971-1240469 | 7/1971 |

OTHER PUBLICATIONS

Jelmar, LLC, Material Safety Data Sheet for CLR Calcium Lime & Rust Remover Enhanced Formula-Dfe, MSDS ID: 540910, pp. 1-5, Aug. 2010.*

Delisio, R. Ellen, Glytone, Ingredients of Glytone, AntiAgeFYI.com.

Jan. 3, 2012 International Search Report for PCT/US11/60415.

Dec. 30, 2011 International Search Report for PCT/US11/60419.

The International Bureau of WIPO, International Preliminary Report on Patentability issued on PCT Application No. US2011/060419, recieved May 23, 2013, 7 pages.

*Primary Examiner* — Brian P Mruk

(74) *Attorney, Agent, or Firm* — Greenberg Traurig, LLP

(57) ABSTRACT

A hard surface cleaning solution having improved cleaning and descaling properties. The cleaning solution includes the following components: a first organic acid, a second organic acid, a surfactant, a solvent and a diluent. The first organic acid is a carboxylic acid, preferably lactic acid, while the second organic acid is also a carboxylic acid, preferably gluconic acid. The surfactant is selected from the group consisting of amine oxides, preferably lauramine oxide. The solvent may be an alkoxylated alcohol, preferably selected from the propylene glycol ether class of compounds.

18 Claims, No Drawings

(56) References Cited

U.S. PATENT DOCUMENTS

| | | | | |
|---|---|---|---|---|
| 7,094,742 | B2 | 8/2006 | Gaudreault | |
| 7,144,846 | B2 | 12/2006 | Keller et al. | |
| 7,368,417 | B2 | 5/2008 | Gaudreault | |
| 7,517,842 | B2 | 4/2009 | Barnhart et al. | |
| 7,622,606 | B2 | 11/2009 | Smith et al. | |
| 7,699,941 | B2 | 4/2010 | Pivonka et al. | |
| 7,745,384 | B2 | 6/2010 | Perry et al. | |
| 2001/0023127 | A1 | 9/2001 | Andreas | |
| 2001/0034313 | A1 | 10/2001 | Honda et al. | |
| 2002/0187918 | A1 | 12/2002 | Urban | |
| 2003/0019508 | A1* | 1/2003 | Tomarchio et al. | 134/6 |
| 2003/0099570 | A1 | 5/2003 | Barnabas et al. | |
| 2003/0100465 | A1 | 5/2003 | Kilkenny et al. | |
| 2003/0216281 | A1 | 11/2003 | DeLeo et al. | |
| 2003/0224958 | A1 | 12/2003 | Andreas | |
| 2004/0023834 | A1 | 2/2004 | Inoue et al. | |
| 2005/0239676 | A1* | 10/2005 | Gaudreault | 510/253 |
| 2005/0282722 | A1* | 12/2005 | McReynolds et al. | 510/302 |
| 2006/0223735 | A1* | 10/2006 | Gaudreault | 510/253 |
| 2008/0267900 | A1 | 10/2008 | Steinbrenner et al. | |
| 2009/0324964 | A1 | 12/2009 | Jaynes et al. | |
| 2010/0022644 | A1 | 1/2010 | Smith et al. | |

* cited by examiner

HARD SURFACE CLEANING COMPOSITION

BACKGROUND OF THE INVENTION

1. Field of the Invention

The present invention relates in general to an improved cleaner for hard surface cleaning applications, including kitchens, bathrooms, tubs and tiles, amongst others, and more particularly to a hard surface cleaning composition having improved cleaning and descaling properties.

2. Background Art

Hard surface cleaning compositions have been known and used in a variety of applications, including bathrooms, kitchens and other areas, particularly for toilets, showers, bathtubs, sinks, tiles, countertops, walls, floors and the like. Often times, hard surfaces accumulate both soap scum stains, which are typically residues of various types of soaps used in a household, as well as hard water stains, which are typically the result of the deposition of calcium, lime or various salts on hard surfaces over the course of time and use of various household surfaces.

Cleaning solutions for these household surfaces have been formulated to address both the removal of soap scum stains, as well as the descaling of hard water stains. In particular, many of these cleaning solutions have employed a combination of components, in a number of instances including strong inorganic acids, organic acids or a combination of both, a surfactant or wetting agent, a solvent and a diluent to address one or both of these types of stains and/or build-ups. The acid component is typically selected to address descaling of hard water stains, while the surfactant component is typically a detergent selected to attack soap scum. Further, other additives have also been used in combination with cleaning formulations to either enhance performance or make a particular formulation more desirable from a visual or odor perspective, such as stabilizing agents, colorants and fragrances, amongst others.

It has also become important for cleaning solutions to be formulated in such a way as to have less impact on the environment (to be "green"). One way in which this is encouraged is through a program of the United States Environmental Protection Agency, known as the Design for the Environment Program ("DfE"). DfE certifies "green" cleaning products through the Safer Product Labeling Program. One aspect for obtaining certification is to have a cleaning solution which is less acidic, specifically, to have a pH greater than 2, for household cleaning products.

It is desirable to provide a cleaning solution which minimizes and/or eliminates the more corrosive inorganic acids, as well as the more corrosive organic acids, and instead uses less corrosive, but equally effective organic acids to achieve the desired cleaning results.

It is yet further desirable to find a cleaning solution with a specific combination of organic acids, surfactants and solvents which act in a synergistic manner to improve cleaning performance on hard surfaces.

SUMMARY OF THE INVENTION

The present invention is directed to a hard surface cleaning solution, which comprises a first organic acid comprising a carboxylic acid selected from the group consisting of lactic acid, glycolic acid, formic acid, citric acid and acetic acid; a second organic acid comprising a carboxylic acid different from the first organic acid and selected from the group consisting of gluconic acid, glycolic acid, formic acid, citric acid and acetic acid; a surfactant selected from the group consisting of amine oxides; and a solvent selected from the group consisting of ether alcohols.

In a preferred embodiment of the invention the first organic acid comprises lactic acid. The first organic acid may comprise about 12 wt. % to about 18 wt. % of the active cleaning composition. The first organic acid may comprise about 16 wt. % of the active cleaning solution.

In another preferred embodiment of the invention, the second organic acid comprises gluconic acid. The second organic acid may comprise about 2.5 wt. % to about 3.75 wt. % of the active cleaning composition. In particular, the second organic acid may comprise about 3.25 wt. % of the active cleaning solution.

In another embodiment of the invention, the surfactant comprises lauramine oxide. The surfactant may comprise about 1.5 wt. % to about 3.25 wt. % of the active cleaning composition. In particular, the surfactant may comprise about 2.00 wt. % of the active cleaning composition.

The solvent may comprise a propylene glycol ether. In particular, the solvent may comprise dipropylene glycol n-butyl ether. The solvent may comprise about 0.5 wt. % to about 3.0 wt. % of the active cleaning composition. In particular, the solvent comprises about 1.4 wt. % of the active cleaning composition.

The composition of the present invention has a pH of 2.0 or greater.

DETAILED DESCRIPTION OF THE INVENTION

While this invention is susceptible of embodiment in many different forms, there are described several specific embodiments with the understanding that the present disclosure is to be considered as an exemplification of the principals of the invention and is not intended to limit the invention to the embodiments so described.

As the present invention is intended to be an improvement over existing hard surface cleaning solutions, it is appropriate to consider the formulations of such existing cleaning solutions.

One cleaning solution that is presently available is sold under the brand name CLR by Jelmar, Inc. CLR has the following formulation:

| Ingredient | Formula % (wt. %) | % Active |
|---|---|---|
| Deionized Water | 68.8893 | N/A |
| Surfactant Mackam LHS Lauryl Hydroxysultaine (Rhodia) | 4.8500 | 2.0370 |
| Organic Acid Purac 88 L(+) Lactic Acid Technical Grade 88% Soln. (Purac America) | 18.3600 | 16.1568 |
| Organic Acid Gluconic Acid Technical Grade 50% Soln. (PMP Fermentation) | 6.5000 | 3.2500 |
| Solvent Dowanol PnB Propylene Glycol Mono-n-Butyl Ether (Dow) | 1.4000 | 1.4000 |
| Coloring Agent Pyla-Cert Green MX-718 (Pylam) | 0.0008 | 0.0008 |

The surfactant in a cleaning solution performs a very important function, which is acting to physically separate a contaminating substance, from the surface to which the contaminating substance is adhered. Then, in such a cleaner, the acids function to attack and dissolve calcium and lime (which refers generally to calcium oxide and calcium hydroxide) deposits as well as rust (iron oxide) deposits. The solvents (e.g., alcohols or ethers or otherwise, etc.) can dissolve other contaminants, such as oils and greases.

The present invention is directed to a liquid cleaning solution which is particularly suited for removing soap scum, hard water stains, lime scale and the like from various hard surfaces such as tubs, tiles, showers, sinks and other areas which are exposed to water and soap. The present invention includes a cleaning solution which is a more vigorous solution more suitable for removing hard water stains, lime scale and rust.

In a preferred embodiment, the cleaning solution includes a first chelating agent, a second chelating agent, a surfactant or wetting agent, a solvent and a diluent. The first and second chelating agents are both organic acids, particularly first and second organic acids, and are preferably selected from the class of carboxylic acids. Organic acids tend to be less corrosive, more environmentally friendly and break down more rapidly than counterpart inorganic acids which are often used in cleaning solutions. The first organic acid is preferably present in an amount of about 12.0 wt. % to about 18.0 wt. %, where the percentage is based upon the active component in the overall cleaning solution composition, which convention will be used throughout this specification unless indicated otherwise. The first organic acid is preferably selected from the group of carboxylic acids including lactic acid, glycolic acid, formic acid, citric acid and/or acetic acid. Most preferably, the first organic acid comprises lactic acid in an amount of 16.16 wt. % of the solution, which is sold under the Purac 88-T brand and can be purchased from Purac America, headquartered in Lincolnshire, Ill.

The second organic acid, preferably present in an amount of approximately 2.5 wt. % to about 3.75 wt % active in the formula, is also preferably a carboxylic acid such as gluconic acid, glycolic acid, formic acid, citric acid and/or acetic acid. Most preferably, the second organic acid is a polyhydroxycarboxylic acid, more preferably gluconic acid purchased under the trade name "PMP Gluconic Acid, 50%" from PMP Fermentation, of Peoria, Illinois. Of course, one of ordinary skill in the art with the present disclosure before them will readily appreciate that other carboxylic acids may also be used within the scope of the present invention.

The most preferred combination of first and second organic acids, namely lactic acid and gluconic acid, tends to be less corrosive than other combinations of organic and/or inorganic acids typically present in commercial hard surface cleaning solutions, which often include citric acid. Further, the gluconic acid is milder on the skin than many alternative acid cleaning components. Additionally, lactic acid and gluconic acid tend to have a more favorable odor than other substitute acids such as formic acid and better cleaning and descaling properties than alternative acids such as glycolic acid. Of course, the most preferred lactic and gluconic acids are also chosen as they have been found to have a synergistic compatibility with each other as well as with the surfactant system and solvent of the present invention. It is important that the organic acids are not reactive with and adverse to the surfactant system, which can cause a drop-off in effectiveness and functionality of the cleaning solution.

The surfactant is preferably an amine oxide; more preferably, lauramine oxide ("LO"), which is also known as lauryldimethylamine oxide, dodecyldimethylamine oxide, or dimethyldodecylamine-N-oxide. Lauramine oxide can be purchased under the trade name Mackamine LO from Rhodia, located in La Defense, France. Other alternative sources of lauramine oxide are Macat AO-12 (from Mason Chemicals) and Ammonyx LO (from Stepan Chemical). Commercially available LO is notable because it does not contain any salt (NaCl) as a result of the production process nor does the chemical itself contain a sodium component. It is believed that surfactants that contain salt (NaCl), or sodium (Na), either as an element of the fundamental surfactant molecules, or as a production byproduct, can have a tendency to suppress the pH of the resulting cleaning solution, even when the pH of the surfactant constituent itself is fairly high (>9 or 10). However, it has also been noted that even using surfactants that clearly lacked a sodium component, either as an element in the fundamental surfactant molecule, or as part of a production byproduct, such as glycosides, which also had a high initial pH, likewise failed to elevate the pH of the final cleaning solution, when the other constituents were as set forth in Table 1 hereinbelow. Only amine oxides, particularly lauramine oxide, were found to elevate the pH to DfE certification levels (a pH of 2.0 or higher), while at the same time providing comparable cleaning performance as the reference prior art cleaning solution (CLR) mentioned above.

The solvent is an ether alcohol based solvent, and preferably an alkoxylated glycol. More preferably, the solvent is selected from a group of propylene glycol ethers, such as dipropylene glycol methyl ether, tripropylene glycol methyl ether, dipropylene glycol normal butyl ether and propylene glycol normal butyl ether. Most preferred is a propylene glycol (mono) butyl ether sold under the trade name Dowanol PnB manufactured by Dow Chemical of Midland, Mich. The solvent is preferably present in the cleaning solution in the range of about 0.50 wt. % to about 3.0 wt. % of the active formula, and most preferably in an amount of about 1.4 wt. % of the active formula. Other solvents may be chosen from glycols based on an ether of preferably the propylene type. Likewise, ethylene type glycol ethers are contemplated for use with the present invention.

The diluent is preferably deionized water, which is present in a range of about 72.0 wt. % to about 83.5 wt. % active in the cleaning solution formula. More preferably, the diluent comprises about 77.15 wt. % of the active cleaning formulation.

Other components may also be added to the cleaning solution of the present invention to add a variety of properties or characteristics, as desired. For instance, additives may include colorants, fragrance enhancers, anionic or nonionic surfactants, corrosion inhibitors, defoamers, pH stabilizers, stabilizing agents, or other additives that would be known by one of ordinary skill in the art with the present disclosure before them. For instance, a colorant is preferred for use with the present cleaning solution, which colorant takes the form of a green colorant purchased as Pyla-Cert Green MX-718, which can be purchased from Pylam Products Company, Inc. of Tempe, Ariz. Such colorant is preferably used in a quantity sufficient to provide the desired color, preferably in the amount of approximately 0.0008 wt. % of the active formula.

Corrosion inhibitors may also be incorporated into the cleaning solution. The preferred class of corrosion inhibitors are imidazolines such as tall oil hydroxyethyl imidazoline, capryl hydroxyethyl imidazoline, cocoyl hydroxyethyl imidazoline, lauryl hydroxyethyl imidazoline and oleyl hydroxyethyl imidazoline. Of course, other corrosion inhibitors may also be used, as would be known by one of ordinary skill in the art with the present disclosure before them. Other additives such as the above described corrosion inhibitors or nonionic surfactants are added in quantities sufficient to impart the desired properties to the cleaning solution, as would be known by those of ordinary skill in the art with the present disclosure before them.

The cleaning solution according to the first embodiment of the present invention described immediately above has a pH of 2.0 or greater, which enables the solution to achieve DfE certification.

The cleaning solutions according to the present invention are typically bottled in plastic containers, and used by wiping (or other direct application) the cleaning composition onto the surface of a tub, tile, sink shower or other surface to be cleaned.

The following example is given to illustrate the cleaning composition of the present invention, but are not intended to limit the invention to the examples included herewith. The following example below specifically illustrates exemplary and preferred formulations of the cleaning composition according to the present invention. It is to be understood that the examples are presented by means of illustration only and that further use of formulations that fall within the scope of the present invention and the claims herewith may be readily produced by one skilled in the art with the present disclosure before them.

Preparation of the Cleaning Solution Formulation

An example formulation illustrating an embodiment of the inventive cleaning composition of the present invention is described in detail in Table I below and was formulated generally in accordance with the following protocol.

EXAMPLE 1

Cleaning Solution Formulation 1

A cleaning solution according to the first embodiment of the present invention was prepared, by introducing appropriate amounts of the indicated constituents, so as to attain the desired relative weight percentages indicated in Table 1 hereinafter, by first charging deionized water into a tank equipped with a mixer. Lactic acid, in the form of Purac 88-T, was then added to the deionized water in the tank. Next, gluconic acid, in the form of PMP Gluconic Acid, were added into the tank. After addition of the gluconic acid, lauramine oxide, in the form of Mackamine LO, were added to the tank from below the surface of the liquid in the tank to minimize foaming. In production, it is preferred to pump the surfactant in through the bottom of a stainless steel tank. After the contents of the tank were mixed thoroughly, the propylene glycol (mono) butyl ether solvent was added into the stainless steel tank in the form of Dowanol PnB. Finally, Plya-Cert Green MX-718 colorant was added to the mixture to achieve the desired color.

Inasmuch as various ones of the raw material components of the cleaning solution are purchased in a form that is at least partially diluted with water, Table 1 provides the percentage of each component which is active in the raw material, the percentage of each particular component (active material and any water in the raw material solution) in the formula and the percentage of each component in the active portion of the formula.

TABLE 1

Cleaning Solution Formulation 1

| Ingredient Name | % Active in Raw Material | % in Formula | % Active in Formula |
|---|---|---|---|
| Deionized Water | | 67.06920 | N/A |
| Purac 88-T Lactic Acid | 88 | 18.36000 | 16.16 |
| PMP Gluconic Acid, 50% Gluconic Acid | 50 | 6.50000 | 3.25 |

TABLE 1-continued

Cleaning Solution Formulation 1

| Ingredient Name | % Active in Raw Material | % in Formula | % Active in Formula |
|---|---|---|---|
| Mackamine LO Lauramine Oxide (Rhodia) | 30 | 6.67000 | 2.00 |
| Dowanol PnB Propylene Glycol (Mono) Butyl Ether | 100 | 1.40000 | 1.40 |
| Pyla-Cert Green MX-718 | 100 | 0.00080 | 0.00080 |

Testing of Example Cleaning Solution Formulation

The hard surface cleaning solution of the present invention was evaluated for rust removal efficacy. Cleaning Formulation 1 was subjected to testing by an independent laboratory to measure the formulation's ability to remove rust stain from white ceramic tiles, according to a standardized test method (Specialized Technology Resources—STR Test Method Number L/PS-TM-241—Rust Stain Removal Procedure), and was found to provide an average rust removal rate of 83.4%. Similar is testing of a known prior art cleaning solution, conventional Jelmar CLR full strength cleaning solution, yielded an average rust removal rate of only 69.5%.

In addition, comparison testing of the cleaning solution of the present invention and the prior art CLR solution on various materials to determine the effect of the cleaning solution on various substrates demonstrated that the cleaning solution of the present invention either produced less, or at least no more adverse affect (e.g., discoloration, change in gloss, blistering, softening, swelling, loss of adhesion, etc.) than the reference cleaning solution.

Accordingly, the present invention has been found to provide more effective rust stain removal as compared with a known prior art cleaning solution, while at the same time producing comparable or fewer adverse surface affects, and providing an elevated pH reaching 2.10 or greater (as compared to the pH of <2 of the prior art CLR solution)—resulting in a more environmentally friendly product.

While this invention is susceptible of embodiment in many different forms, there is shown in the drawings and will herein be described in detail, a preferred embodiment with the understanding that the present disclosure should be considered as an exemplification of the principles of the invention and is not intended to limit the invention to the embodiment so illustrated.

The invention claimed is:

1. A hard surface cleaning solution for descaling calcium, lime and rust, consisting essentially of:

a first organic acid comprising a carboxylic acid selected from the group consisting of lactic acid, glycolic acid, formic acid, citric acid and acetic acid;

a second organic acid comprising a carboxylic acid different from the first organic acid and selected from the group consisting of gluconic acid, glycolic acid, formic acid, citric acid and acetic acid;

a surfactant selected from the group consisting of amine oxides;

a solvent selected from the group consisting of ether alcohols; and a diluent;

wherein the solution has a pH ranging from about 2.0 to about 2.4;

wherein the solution effectively descales calcium, lime and rust; and wherein the surfactant does not contain salt in an amount sufficient to materially affect the pH of the hard surface cleaning solution.

2. The hard surface cleaning solution of claim 1 wherein the first organic acid comprises lactic acid.

3. The hard surface cleaning solution of claim 1 wherein the first organic acid comprises about 12 wt. % to about 18 wt. % of the active cleaning composition.

4. The hard surface cleaning solution of claim 1 wherein the first organic acid comprises about 16 wt. % of the active cleaning solution.

5. The hard surface cleaning solution of claim 1 wherein the second organic acid comprises gluconic acid.

6. The hard surface cleaning solution of claim 1 wherein the second organic acid comprises about 2.5 wt. % to about 3.75 wt. % of the active cleaning composition.

7. The hard surface cleaning solution of claim 6 wherein the second organic acid comprises about 3.25 wt. % of the active cleaning solution.

8. The hard surface cleaning solution of claim 1 wherein the surfactant comprises lauramine oxide.

9. The hard surface cleaning solution of claim 1 wherein the surfactant comprises about 1.5 wt. % to about 3.25 wt. % of the active cleaning composition.

10. The hard surface cleaning solution of claim 9 wherein the surfactant comprises about 2.00 wt. % of the active cleaning composition.

11. The hard surface cleaning solution of claim 1 wherein the solvent comprises a propylene glycol ether.

12. The hard surface cleaning solution of claim 11 wherein the solvent comprises dipropylene glycol n-butyl ether.

13. The hard surface cleaning solution of claim 1 wherein the solvent comprises about 0.5 wt. % to about 3.0 wt. % of the active cleaning composition.

14. The hard surface cleaning solution of claim 1 wherein the solvent comprises about 1.4 wt. % of the active cleaning composition.

15. The hard surface cleaning solution of claim 1 further including an additive selected from the group consisting of colorants, fragrance enhancers, nonionic surfactants, corrosion inhibiting agents, defoamers, pH stabilizers and stabilizing agents.

16. A hard surface cleaning composition for descaling calcium, lime and rust, consisting essentially of:

lactic acid, in an amount of about 12 wt. % to about 18 wt. % of the active cleaning composition;

gluconic acid, in an amount of about 2.5 wt. % to about 3.75 wt. % of the active cleaning composition;

an amine oxide, in an amount of about 1.5 wt. % to about 3.25 wt. % of the active cleaning composition;

dipropylene glycol n-butyl ether, in an amount of about 0.5 wt. % to about 3.0 wt. % of the active cleaning composition;

deionized water, in an amount of about 72.0 wt. % to about 83.50 wt. % of the active cleaning composition;

wherein the composition has a pH ranging from about 2.0 to about 2.4;

wherein the composition effectively descales calcium, lime and rust; and wherein the surfactant does not contain salt in an amount sufficient to materially affect the pH of the hard surface cleaning solution.

17. A hard surface cleaning solution for descaling calcium, lime and rust, comprising:

a first organic acid comprising a carboxylic acid selected from the group consisting of lactic acid, glycolic acid, formic acid, citric acid and acetic acid;

a second organic acid comprising a carboxylic acid different from the first organic acid and selected from the group consisting of gluconic acid, glycolic acid, formic acid, citric acid and acetic acid;

a surfactant selected from the group consisting of amine oxides;

a solvent selected from the group consisting of ether alcohols; and a diluent;

wherein the solution has a pH ranging from about 2.0 to about 2.4;

wherein the solution effectively descales calcium, lime and rust; and wherein the surfactant does not contain salt in an amount sufficient to materially affect the pH of the hard surface cleaning solution.

18. The hard surface cleaning solution of claim 17 wherein the solution provides an average rust removal rate of about 83.4%.

* * * * *